US006651622B2

(12) United States Patent
Yanagii

(10) Patent No.: US 6,651,622 B2
(45) Date of Patent: Nov. 25, 2003

(54) THROTTLE VALVE CONTROL APPARATUS IN INTERNAL COMBUSTION ENGINE

(75) Inventor: Yoichi Yanagii, Kawasaki (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 10/238,138

(22) Filed: Sep. 9, 2002

(65) Prior Publication Data

US 2003/0047165 A1 Mar. 13, 2003

(30) Foreign Application Priority Data

Sep. 11, 2001 (JP) ..... 275116

(51) Int. Cl.[7] ..... F02D 1/00
(52) U.S. Cl. ..... 123/399; 73/118.1; 251/305
(58) Field of Search ..... 123/399, 400; 251/305; 73/118.1

(56) References Cited

U.S. PATENT DOCUMENTS 5,046,575 A * 9/1991 Asayama ..... 180/178
5,048,485 A * 9/1991 Terazawa et al. ..... 123/399
5,205,157 A * 4/1993 McDaniel ..... 73/49.2
5,868,114 A * 2/1999 Kamimura et al. ..... 123/399
6,349,701 B1 * 2/2002 Sakurai et al. ..... 123/399

* cited by examiner

*Primary Examiner*—John Kwon
(74) *Attorney, Agent, or Firm*—Zito tlp; Joseph J. Zito; Kendal M. Sheets

(57) ABSTRACT

To provides a throttle valve control apparatus which can stably detect an angle of a throttle valve shaft for a long time with no hysteresis in detecting an angle of the throttle valve shaft, and can make a motor for driving the throttle valve shaft compact, an intake passage 2 is controlled to be opened and closed by a throttle valve 4 mounted to a throttle valve shaft 3, a spring force in a direction for closing of the throttle valve 4 is energized to the throttle valve shaft 3 by a throttle return spring 6, the throttle valve shaft 3 is operated to be opened and closed by a motor M driven according to a signal output from an ECU, a rotation angle of the throttle valve shaft 3 is detected by an opening degree sensor T arranged to face to the throttle valve shaft 3, this angle signal is output toward the ECU, and a sensor rotor TA constituting the opening degree sensor is pressed and energized to an end portion of the throttle valve shaft 3 in a rotation direction of the throttle valve 4 by a rotor return spring 10 which energizes the sensor rotor in a direction for opening of the throttle valve 4.

1 Claim, 3 Drawing Sheets

PRIOR ART

THROTTLE VALVE CONTROL APPARATUS IN INTERNAL COMBUSTION ENGINE

BACKGROUND OF THE INVENTION

1. Field of the Invention

The present invention relates to a throttle valve control apparatus which controls an amount of air flowing toward an engine, and more particularly to a throttle valve control apparatus of a so-called drive-by-wire type in which a throttle valve for controlling an opening area of an intake passage extending through a throttle body is driven by a motor operating in correspondence to an electric signal output from an ECU.

2. Conventional Art

A description will be given of a conventional throttle valve control apparatus with reference to FIG. 3. Reference numeral 1 denotes a throttle body, inside which an intake passage 2 is provided through. The intake passage 2 is controlled so as to be opened and closed by a throttle valve 4 which is attached to a throttle valve shaft 3 rotatably supported to the throttle body 1. The left end of the throttle valve shaft 3 in the drawing protrudes toward the left side from the throttle body 1, a throttle valve lever 5 is fixed to and arranged at the left end, and a spring force in a direction for closing the throttle valve 4 (this spring force is shown by a clockwise direction A in FIG. 2) is energized to the throttle valve shaft 3 by a throttle return spring 6. That is, the throttle return spring 6 is arranged in the outer periphery of the throttle valve shaft 3, one end thereof is engaged with the throttle body 1, and another end thereof is engaged with the throttle valve lever 5. Further, an opening degree sensor T and a motor M are arranged at the right end of the throttle valve shaft 3. The opening degree sensor T is structured such as to output an electric voltage, which is in proportion to a rotation angle of the throttle valve shaft 3, toward an ECU (not shown), and a groove of flat face TB of a sensor rotor TA constituting the opening degree sensor T is engaged with and arranged in a portion of flat face 3A formed at the right end of the throttle valve shaft 3, whereby the throttle valve shaft 3 and the opening degree sensor T are synchronously rotated. Further, the motor M is driven on the basis of an output signal from the ECU (not shown), a first gear 7A is fixed to and arranged on an output shaft MA of the motor M, a second gear 7B is fixed to and arranged near the right end of the throttle valve shaft 3, and the first gear 7A and the second gear 7B are engaged with each other, whereby a rotation of the motor M is transmitted to the throttle valve shaft 3. In accordance with the structure mentioned above, when the signal is output from the ECU toward the motor M, the motor M is rotated accordingly, and this rotation is transmitted to the throttle valve shaft 3 via the output shaft MA, the first gear 7A and the second gear 7B so as to rotate the throttle valve shaft 3, whereby the throttle valve 4 can control the opening of the intake passage 2 in correspondence to the output signal of the ECU. In the operation mentioned above, the motor M is rotated against a spring force of a throttle return spring 6 at a time when the throttle valve 4 is operated to be opened.

In accordance with the conventional throttle valve control apparatus mentioned above, the throttle valve shaft 3 and the opening degree sensor T are structured such that the portion of flat face 3A at the right end of the throttle valve shaft 3 is inserted and arranged within the groove of flat face TC of the sensor rotor TA in the opening degree sensor T and they are connected to be interlocked, whereby a hysteresis is generated at the opening operation time and the closing operation time due to a gap in the insertion portion, so that there is a risk that an accurate angle detection of the throttle valve shaft 3 is damaged. Further, in accordance with the gap mentioned above, a punching abrasion is generated at a long time use, and there is a risk that the gap is expanded and the detection capability is further reduced.

SUMMARY OF THE INVENTION

The present invention is made by taking the problem mentioned above into consideration, and an object of the present invention is to provide a throttle valve control apparatus which can stably detect an angle of a throttle valve shaft for a long time with no hysteresis in detecting an angle of the throttle valve shaft, and can make a motor for driving the throttle valve shaft compact.

In order to achieve the object mentioned above, in accordance with the present invention, there is provided a throttle valve control apparatus in an internal combustion engine comprising:

- a throttle valve which is mounted to a throttle valve shaft crossing over an intake passage provided in a throttle body so as to open and close the intake passage;
- a motor which is arranged in one end of the throttle valve shaft via a gear and controls to open and close the throttle valve on the basis of an output signal from an ECU;
- an opening degree sensor which is arranged so as to face to an end portion of the throttle valve shaft, detects a rotation angle of the throttle valve shaft, and outputs a rotation angle signal toward the ECU; and
- a throttle return spring which energizes a force in a direction of closing the throttle valve with respect to the throttle valve shaft,
- wherein a sensor rotor constituting the opening degree sensor is pressed and energized to an end portion of the throttle valve shaft in a rotation direction of the throttle valve, by a rotor return spring which energizes the sensor rotor in a direction for opening of the throttle valve.

In accordance with the throttle valve control apparatus of the present invention, the groove of flat face in the sensor rotor is always pressed toward the portion of flat face in the throttle valve shaft in the rotation direction thereof by the rotor return spring, and the groove of flat face and the portion of flat face are always kept in the pressed state. Accordingly, no hysteresis is generated in the output signal from the opening degree sensor in the direction of opening and closing for the throttle valve shaft, and no punching abrasion is generated between the groove of flat face and the portion of flat face at the long time use. Further, since the pressing direction of the spring force in the rotary return spring is set to be reverse to the pressing direction of the spring force in the throttle return spring, it is possible to reduce the relative spring force of the throttle return spring applied to the throttle valve shaft, whereby it is possible to employ a compact motor having a low rotational torque.

DESCRIPTION OF THE PREFERRED EMBODIMENT

Figure 1:
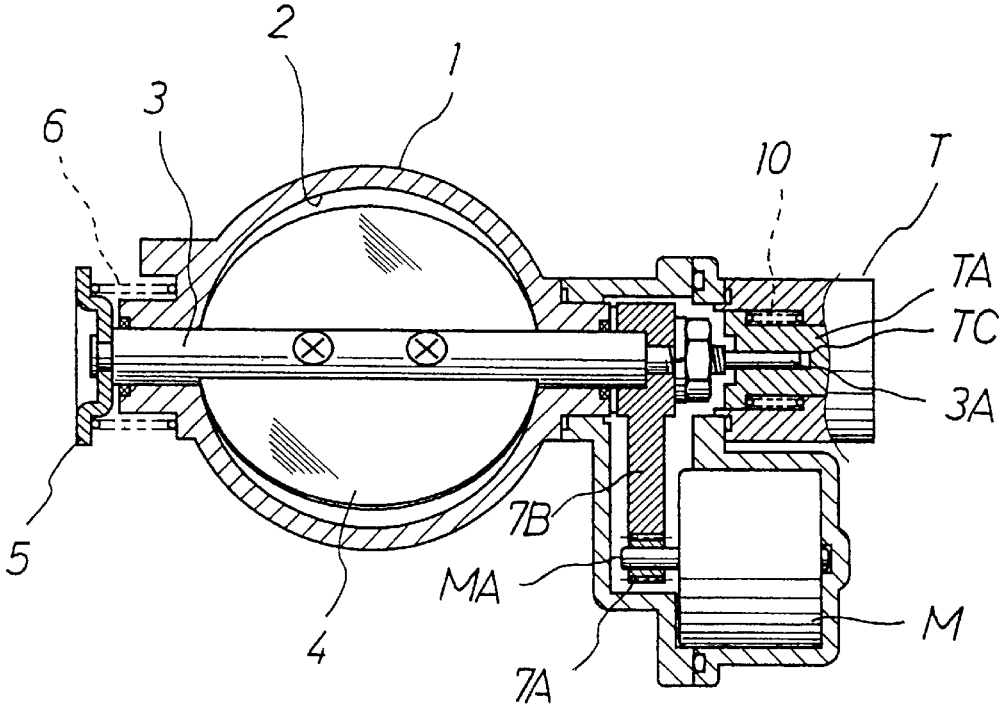
FIG. 1 is a vertical cross sectional view of a main portion showing one embodiment of a throttle valve control apparatus in an internal combustion engine in accordance with the present invention.
Figure 2:
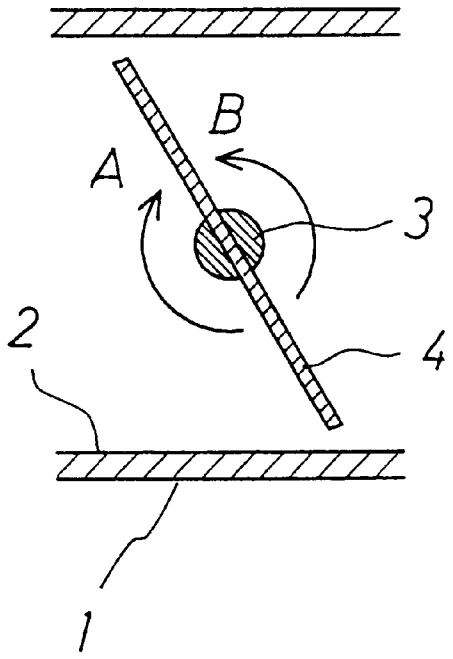
FIG. 2 is a schematic view showing energizing directions of spring forces in a rotary return spring and a throttle return spring with respect to a throttle valve.

A description will be given below of an embodiment of a throttle valve control apparatus in an internal combustion engine in accordance with the present invention with reference to FIG. 1. In this case, the same reference numerals are used for the same constituting parts as those in FIG. 3, and a description thereof will be omitted. Reference numeral 10 denotes a rotary return spring which is arranged in an outer periphery of a sensor rotor TA. In the sensor rotor TA, a spring force in a direction for opening of the throttle valve 4 (this spring force is shown by a counterclockwise direction B in FIG. 2) is energized thereby. In this case, a spring force of the rotary return spring 10 is set to be weaker than a spring force of the throttle return spring 6. This is because the throttle valve 4 is rotated in a closing direction by the spring force of the throttle return spring 6 at a time when an electric current application to the motor M is shut off for some reasons or the like.

Figure 3:
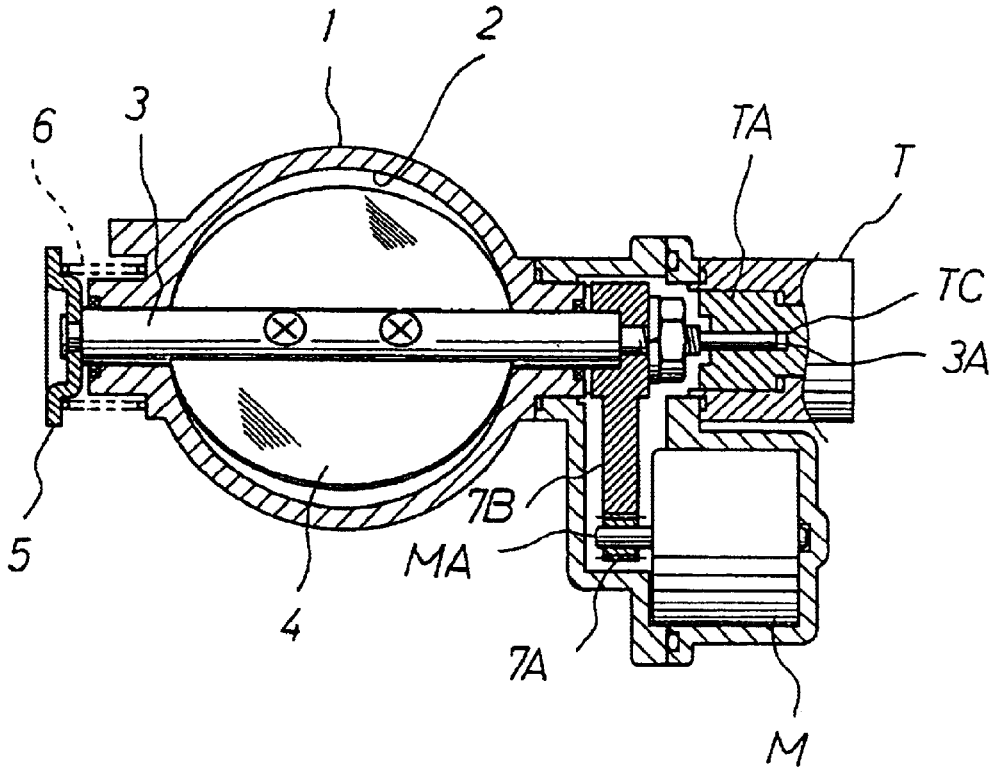
FIG. 3 is a vertical cross sectional view of a main portion showing a conventional throttle valve control apparatus.

In accordance with the structure mentioned above, since the sensor rotor TA is always energized in the direction for opening of the throttle valve 4 by a spring force of the rotary return spring 10, and the groove of flat face TC of the sensor rotor TA is always brought into contact with one side surface of the portion of flat face 3A of the throttle valve shaft 3 so as to be locked in a state of being pressed and energized thereto, no gap exists in a connection portion between the throttle valve shaft 3 and the opening degree sensor T, no hysteresis is generated at a time when the throttle valve shaft 3 rotates forward and rotates backward (in other words, at a time when the throttle valve 4 is opened and closed), and the opening degree sensor T extremely accurately detects the rotation angle of the throttle valve shaft 3 and can output a signal corresponding thereto toward the ECU. Further, as mentioned above, since the portion of flat face 3A and the groove of flat face TC can be arranged so as to be always brought into contact with each other, no punching abrasion is generated between the portion of flat face 3A and the groove of flat face TC at a time of the opening and closing operations of the throttle valve shaft 3, and it is possible to stably detect the rotation angle of the throttle valve shaft 3 for a long time. Further, as shown in FIG. 3, since the spring force of the rotary return spring 10 is applied toward the direction for opening of the throttle valve 4, and the spring force of the throttle return spring 6 is applied toward the direction for closing of the throttle valve 4, it is possible to weaken the spring force in the direction for closing of the throttle valve 4 applied to the throttle valve shaft 3 in correspondence to the spring force of the rotary return spring 10, whereby it is possible to employ a compact motor having a small torque. Further, since the compact motor is employed, it is possible to achieve a low cost of the motor, and it is possible to achieve a compact size of the throttle body, whereby it is possible to improve a mounting property, in particular, to a two-wheeled vehicle in which a receiving space is limited.

As mentioned above, in the throttle valve control apparatus in the internal combustion engine according to the present invention, since the throttle valve which is mounted to the throttle valve shaft crossing over the intake passage provided in the throttle body so as to open and close the intake passage; the motor which is arranged in one end of the throttle valve shaft via the gear and controls to open and close the throttle valve on the basis of the output signal from the ECU; the opening degree sensor which is arranged so as to face to the end portion of the throttle valve shaft, detects the rotation angle of the throttle valve shaft, and outputs the rotation angle signal toward the ECU; and the throttle return spring which energizes the force in the direction for closing of the throttle valve with respect to the throttle valve shaft are provided, and in this structure, the sensor rotor constituting the opening degree sensor is pressed and energized to the end portion of the throttle valve shaft in the rotation direction of the throttle valve, by the rotor return spring which energizes the sensor rotor in the direction for opening of the throttle valve, it is possible to output the accurate signal toward the ECU from the opening degree sensor with respect to the rotation angle of the throttle valve shaft with no hysteresis. Further, since a play in the connection portion between the throttle valve shaft and the opening degree sensor can be absorbed, it is possible to accurately and stably output the rotation angle signal of the throttle valve shaft for a longtime. Further, it is possible to employ the motor having a small torque, whereby it is possible to reduce a cost of the motor and make the throttle body compact. Further, it is possible to improve the mounting property, in particular, to the two-wheeled vehicle in which the receiving space is limited.

What is claimed is:

1. A throttle valve control apparatus in an internal combustion engine comprising:

a throttle valve which is mounted to a throttle valve shaft crossing over an intake passage provided in a throttle body so as to open and close the intake passage;

a motor which is arranged in one end of the throttle valve shaft via a gear and controls to open and close the throttle valve on the basis of an output signal from an ECU;

an opening degree sensor which is arranged so as to face to an end portion of said throttle valve shaft, detects a rotation angle of the throttle valve shaft, and outputs a rotation angle signal toward the ECU; and a throttle return spring which energizes a force in a direction of closing the throttle valve with respect to the throttle valve shaft, wherein a sensor rotor TA constituting said opening degree sensor is pressed and energized to an end portion of the throttle valve shaft 3 in a rotation direction of the throttle valve 4, by a rotor return spring 10 which energizes the sensor rotor in a direction of opening the throttle valve 4.

* * * * *